US005278768A

United States Patent [19]

Brum

[11] Patent Number: 5,278,768

[45] Date of Patent: Jan. 11, 1994

[54] AUTOTRIP OPERATION OF A SORTING MACHINE USING COLOR SORTING

[75] Inventor: Jerry W. Brum, Modesto, Calif.

[73] Assignee: ESM International, Inc., Houston, Tex.

[21] Appl. No.: 709,485

[22] Filed: Jun. 3, 1991

[51] Int. Cl.[5] ..... B07C 5/342

[52] U.S. Cl. ..... 364/478; 209/564; 209/582; 356/407; 250/226

[58] Field of Search ..... 364/478, 526; 209/580, 209/581, 582, 587, 555, 577, 558, 563; 209/565, 356/402, 407, 408, 425; 250/233 R, 260; 356/402, 407, 408, 425; 250/226, 233

[56] References Cited

U.S. PATENT DOCUMENTS

| | | | |
|---|---|---|---|
| 3,980,181 | 9/1976 | Hoover et al. | 209/111.6 |
| 4,131,540 | 12/1978 | Husome et al. | 209/582 |
| 4,132,314 | 1/1979 | von Beckman et al. | 209/565 |
| 4,134,498 | 1/1979 | Jones et al. | 209/564 |
| 4,170,306 | 10/1979 | Marshall et al. | 250/226 |
| 4,205,752 | 6/1980 | Malvick et al. | 209/582 |
| 4,207,985 | 6/1980 | Lockett et al. | 209/582 |
| 4,225,242 | 9/1980 | Lane | 356/407 |
| 4,235,342 | 11/1980 | Braham | 209/582 |
| 4,241,835 | 12/1980 | Lockett | 209/582 |
| 4,260,062 | 4/1981 | Lockett | 209/582 |
| 4,344,539 | 8/1982 | Lockett | 364/478 |
| 4,364,886 | 1/1983 | Lane et al. | 209/564 |
| 4,558,786 | 12/1985 | Lane | 209/558 |

*Primary Examiner*—Jerry Smith
*Assistant Examiner*—Thomas E. Brown
*Attorney, Agent, or Firm*—Vaden, Eickenroht, Thompson, Boulware & Feather

[57] ABSTRACT

A dynamic trip level setting apparatus is described for changing the comparison ratio with which products are optically sorted using first and second reflectance color values. The reflectance ratio for each image sorted is supplied to a RAM to update the RAM's memory. The dynamic values in the RAM are periodically employed to update a color sensitivity factor supplied to a battery-backed RAM. The battery-backed RAM value is employed in a logic device employing an algorithm and produces a variable output against which the ratio of "breaker" products (neither above a first color acceptance level nor below a second color reject level) is compared to produce a reject signal when the comparison results in an output indicating reject is appropriate.

7 Claims, 4 Drawing Sheets

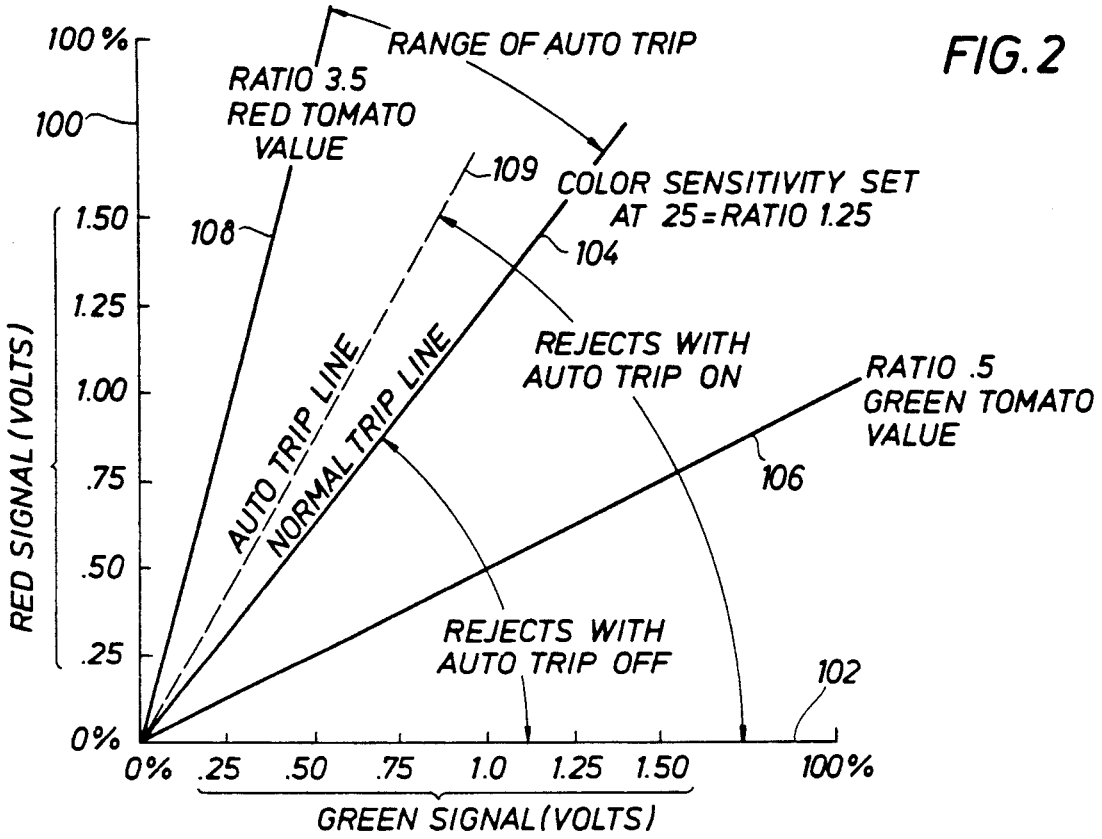
FIG. 2
100%
100
1.50
1.25
1.00
.75
.50
.25
0%
RED SIGNAL (VOLTS)
RANGE OF AUTO TRIP
RATIO 3.5
RED TOMATO
VALUE
108
109
COLOR SENSITIVITY SET
AT 25 = RATIO 1.25
104
AUTO TRIP LINE
NORMAL TRIP LINE
REJECTS WITH
AUTO TRIP ON
RATIO .5
GREEN TOMATO
VALUE
106
REJECTS WITH
AUTO TRIP OFF
102
0%
.25
.50
.75
1.0
1.25
1.50
100%
GREEN SIGNAL (VOLTS)

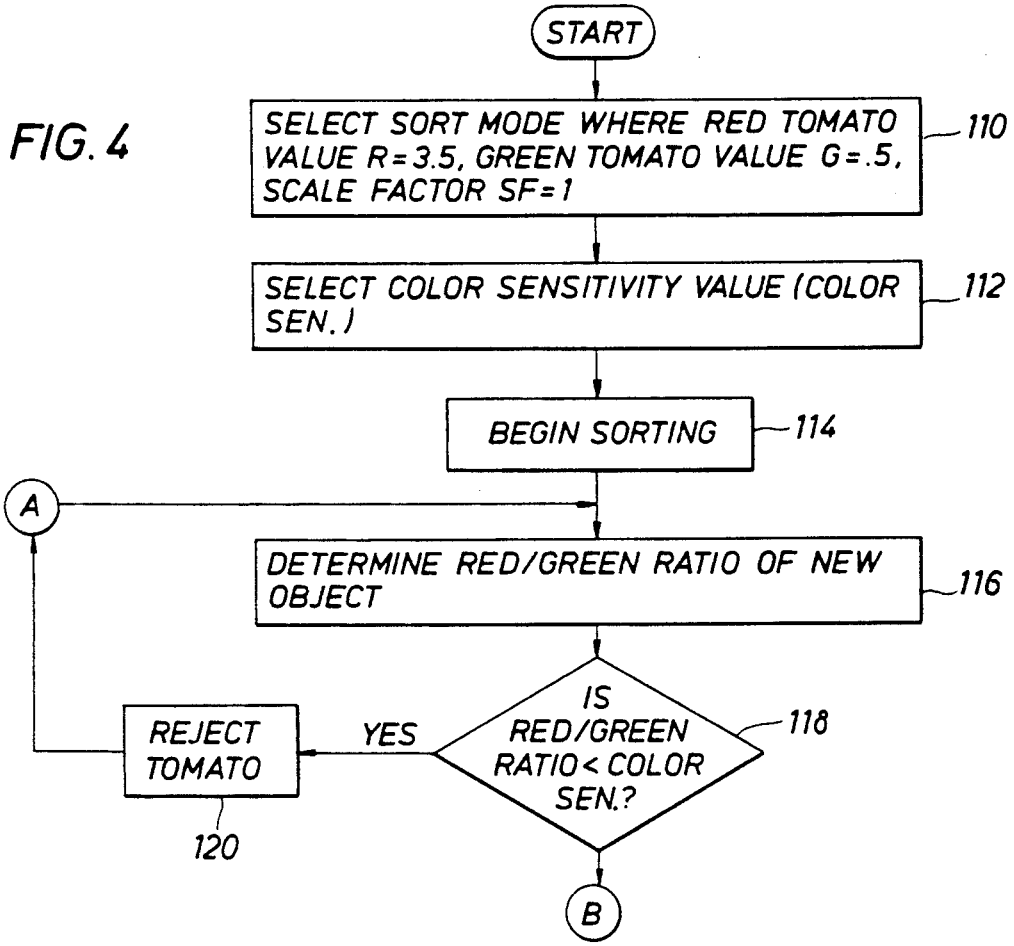
FIG. 4
START
SELECT SORT MODE WHERE RED TOMATO VALUE R=3.5, GREEN TOMATO VALUE G=.5, SCALE FACTOR SF=1
110
SELECT COLOR SENSITIVITY VALUE (COLOR SEN.)
112
BEGIN SORTING
114
A
DETERMINE RED/GREEN RATIO OF NEW OBJECT
116
IS RED/GREEN RATIO < COLOR SEN.?
118
YES
REJECT TOMATO
120
B

AUTOTRIP OPERATION OF A SORTING MACHINE USING COLOR SORTING

BACKGROUND OF THE INVENTION

1. Field of the Invention

This invention pertains to dynamically adjusting the accept/reject level of an electronically controlled sorting machine in accordance with the actual objects being sorted.

2. Description of the Prior Art

This invention may be used with many types of sorting machines used for sorting different kinds of objects or products. A typical sorting machine of the type envisioned for this invention is a color food sorting machine comprising many different components in order to electronically discriminate unacceptable from acceptable food products and mechanically separate (i.e. sort) the bad from the good. These components are generally comprised of one or more lighting illumination sources; optical assemblies for viewing, focusing, and light wavelength filtering; photocell detectors for converting light energy into electricity; and various electronic circuits for amplifying, conditioning and classifying resultant signals into acceptable and unacceptable occurrences. For multiple channel sorting machines, multiple sets of these various components are packaged into one machine. An example of a typical system is the COLORWATCH System No. 490033 of ESM International, Inc.

In most instances, a sorting machine electrically discriminates unacceptable from acceptable products by optically detecting the color of the product and comparing it to a minimum acceptable color. If the product's color does not meet the minimum requirement, the product is rejected.

In order to remove the rejected product, such machines include an ejector mechanism located downstream from the sensor or sensors and actuated by an electrical signal originating from sensor detection. When a substandard product is detected, an electrical actuating signal is produced and the ejector is actuated just as the substandard product and the mechanism are in alignment. Therefore, there is a slight delay between detection and ejection.

Even though some sorting machines are more efficient than others, none are mechanically perfect. All machines presently in the market capture at least some objects that should have been rejected. The percentage of error due to the mechanical deficiency is consistent for a given machine. However, these mechanical limitations are amplified when there are significant variations in the products over the area of interest. For example, a growth rate of a product such as a tomato may be inconsistent throughout a field. The sorter may pass over an area where most of the tomatoes should be rejected because of the unacceptable color. Inevitably in such a situation, more unacceptable products will be classified as acceptable than should be because there are more unacceptable products present.

These limitations can have a profound impact on any given industry, and in particular the farming industry. For example, when a farmer harvests a field of tomatoes and sells them to a cannery, his paid tonnage for tomatoes is subject to dockage in relation to the quality of his fruit. One of the measures of quality is the degree of "color quality" (ripeness) of the tomatoes. A farmer can be penalized to the point of complete rejection of a load of fruit if during the sampling process it exceeds the state tolerance of green tomato content.

Tomato fields may have areas that contain a preponderance of "green" or "breaker" (immature) tomatoes. Traditionally a farmer is forced to sacrifice a portion of his deliverable fruit by setting his equipment to accept only tomatoes that are red ripe in order to insure that his overall color quality requirements are met.

Therefore, it is a feature of the present invention to provide an improved method of dynamically adjusting the accept/reject level of an electronically controlled sorter to obtain true color average in a load of sorted objects thus minimizing the amount of products rejected.

It is another feature of this invention to provide an improved method of automatically making a sorting machine more sensitive in areas that contain a high percentage of unacceptable product.

It is yet another feature of this invention to provide an improved method of optimizing the sensitivity of the sorter particularly in areas where the effects of mechanical limitations of the sorter become more prevalent.

SUMMARY OF THE INVENTION

An electronically controlled sorting machine has the capability of dynamically adjusting the accept/reject level (hereinafter called color sensitivity level) of a product being sorted to enhance the sensitivity of the sorter in accordance with the product entering the machine. This capability (hereinafter called "autotrip function") is a software algorithm implemented in a system with available random access memory (hereinafter call "RAM"). When activated, the autotrip function calculates a new accept/reject level (hereinafter called "autotrip value") to which all product being sorted will be compared to determine whether the product is acceptable. The autotrip value will increase, that is, the range of acceptable product will narrow, in areas where there is a higher percentage of unacceptable products.

The autotrip function allows a user to optimize or heighten the sensitivity of the sorting machine by scaling the autotrip value. The scaling factor (hereinafter called "autotrip sensitivity factor") is reflective of the actual color sensitivity value and the actual product being collected.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the exemplary preferred embodiment thereof which is illustrated in the drawings, which form a part of this specification. It is to be noted, however, that the appended drawings illustrate only a typical preferred embodiment of the invention and are not to be considered limiting of its scope as the invention may admit to other equally effective embodiments.

In the drawings:

FIG. 2 is a graphic representation of how a sorting machine having a dynamic trip level setting apparatus discriminates with respect to a quantity of sorted goods and adjusts its accept/reject level in accordance with the present invention.

FIGS. 4 and 5 are simplified flow diagrams of the sorting routine for a sorting machine in accordance with the present invention.

DESCRIPTION OF THE PREFERRED EMBODIMENTS

Figure 1:
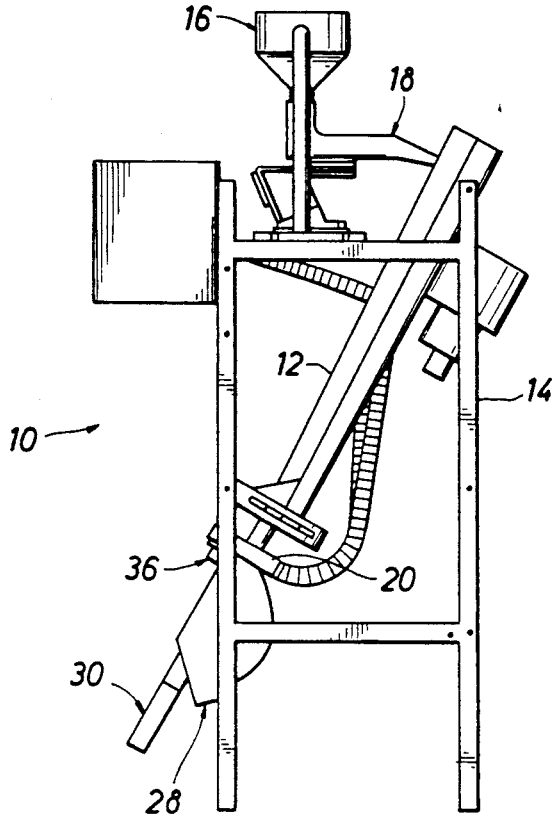
FIG. 1 is a side view of a simplified sorting machine employing the invention.

Now referring to the drawings, and first to FIG. 1, a sorter for separating graded fungible comestible products or items from a passing stream or flow of such products is shown. Generally, machine 10 includes one or more channels or chutes or slides 12 at a steep angle, usually over 45° and preferably nearly vertical on the order of 80°. The channels are held in position by a framework 14 and are gravity fed the product to be sorted at the top by a hopper 16 or a conveyor belt attached to the same framework. The product feeds from hopper 16 through a feeder 18 to channels 12. Although a commercial machine usually has two or more channels 12 operating simultaneously with respect to the product that flow respectively through them, for simplicity of discussion, machine 10 is discussed hereinafter as including only a single channel. 12.

The products to be separated or sorted by machine 10 are normally comestible products such as tomatoes that are graded and separated on the basis of color characteristics. Of course, any products, comestible or other, that are separable on the basis of color distinctions as discussed hereinafter can be sorted employing the invention described herein.

An optical viewer or sensor 20 is located toward the bottom part of the channel. As the flow of products passes past the sensor, any nonstandard or substandard products are sensed or detected. This sensing can be in a single spectral range for monochromatic detection, in two separated spectral ranges for bichromatic detection, or in a plurality of spectral ranges for multichromatic detection. It is understood that a "spectral range" can be wholly or partially in the visual spectrum or can be wholly or partially in the nonvisual spectrum. For example, sensing in the infrared range is commonly done. When a substandard product or item is sensed, an electrical signal is produced that results in an ejection of the substandard item by the actuation of the ejector mechanism.

An ejector 36 located underneath and adjacent optical sensor means 20 is actuated by the actuation electrical signal just mentioned to produce an air blast or to otherwise remove the unwanted substandard product from the flow of products in the product stream. The ejector can be a mechanical ejector, if desired. When the actuation signal occurs, typically, a solenoid valve is operated to release or emit an air blast at the product stream to timely remove the substandard item. The delay in actuation is very short following the time of sensing, the timing being such to produce the desire expelling of the detected substandard item and is accomplished in a manner well known in the art. The items thus removed in the process fall down into reject accumulator 28 for subsequent disposal. The items not removed continue down channel extension 30 to be gathered or packaged as quality products passing the preset standards and avoiding removal. The control of the flow and the sensitivity of the sensors are controlled by preset controls that are well-known in the art.

The sorting machine used in the preferred embodiment of this invention, the COLORWATCH MODEL NO. 490033, is an electronically controlled optical sorting machine. The basic principles of operation are typical of other electronically controlled optical sorters. A product is brought into the machine, tested for distinguishing characteristics, and accepted or rejected based on those characteristics. However, this machine is specifically designed to discriminate between acceptable and unacceptable tomatoes by optically detecting the color of each tomato and comparing it to a minimum acceptable color.

When the sorting machine is operating, product passes or falls from a conveyor belt in front of a window. As the product falls, it enters the view of one or more of the 32 individual optical channels. Light generated by four colors of light emitting diodes (LEDs) is reflected from the product back into the 32 optical channels. Each channel includes a lens and a photocell. The lens collects reflected light from the product and directs the light to a photocell. The photocell converts the light to an electric current. For each of the four LED colors, the electrical current is proportional to the amount of that color in the viewed portion of the object.

Specifically, for every 1/40th of an inch of travel through the lens/photocell assembly, each viewed image is converted into electronic signals by photocell detection of the magnitudes of reflectance for each of four wavelengths of light. Each signal coming from the lens/photocell assembly is filtered to remove ambient light, background clutter and noise.

When an object is initially detected, four variables are initialized with the reflectance values of each of the four wavelengths, and a count variable is initialized to one which represents the first scan. Each successive scan that the object is still in view, the signals are added to the previous sum in the four variables, and the count variable is incremented by one.

After a previously detected object is no longer in view in the lens/photocell assembly, each object is identified with four variables defining the total magnitude for each of 4 wavelengths, and a variable defining the number of scans the object was in view. The object's reflectance values for each wavelength of light are averaged by dividing the number of scans into each of the four wavelength sums. An object is now defined by four average values for each wavelength.

Each of these four averages are now normalized by multiplying them by a calibration value for each wavelength of light for the respective sensor that the object passed through. The normalizing step eliminates the aging and irregularities of amplifier and lamp magnitudes.

The color red is defined by having a predetermined reflectance value in one or more of the four wavelengths chosen for operation. Usually, two wavelengths are chosen for viewing for each color. Therefore, for such a case to be a bright red, the reflectance values would be above a predetermined standard amount in each of two preselected wavelengths. In similar fashion, to be a bright green, the reflectance values would be above a predetermined standard amount in each of two different preselected wavelengths.

A single value or a single combination value from the multiple wavelengths selected for a given color, following normalization, is amplified and converted to a digital signal using an analog-to-digital converter. The digital value of the signal is processed by a microprocessor to determine when an object is in view and the color values for the object.

A second microprocessor uses the reflected color values to determine the overall object color. If the object is not within a range of color values selected by the operator, the product is rejected. An ejector mounted below the viewing area serve to divert unacceptable product out and away from the machine while acceptable product passes into an accept area directly in front of the machine.

The color of the product accepted by the sort machine is selected by the operator. This value is called the color sensitivity value and is expressed as a value between 00 and 99. Internally, this value is scaled from red tomato value to green tomato value, both of which are expressed as ratios of "red" to "green" and are set by the manufacturer of the sort machine. For red and green colors, the ratio is the amount of reflected "red" light divided by the amount of reflected "green" light.

Typically a red object will reflect a large amount of red light and little if any green light. In this case, the object would have a large red/green ratio, say greater than four. In comparison, a green object will reflect a large amount of green light and little red light. As a result this product would have a small ratio of say 0.2.

FIG. 2 is a graphic description of how the sorting machine determines the color of an object. The vertical axis 100 represents the intensity of reflected red light from zero at the bottom to 100% at the top. The horizontal axis 102 represents the intensity of reflected green light from zero at the left to 100% to the right. If an object produces a red signal of 2 Volts when the red LEDs are ON and a signal of 1.5 volts with the green LED's ON, the red/green ratio is 1.33.

The manufacture of the sorting machine sets a ratio of 0.5 equivalent to an unacceptable green tomato value 106, whereas a red/green ratio of 3.5 is equivalent to an acceptable red tomato value 108. These reference values are put into memory at the factory.

The color trip line 104 is set by the color sensitivity value selected by the operator. In the drawing, a normal trip line 104 value of 1.25 is set. The position of this line as a ratio ranges from the "green tomato value" of 0.5 to the "red tomato value" of 3.5. The green tomato value and red tomato value can be adjusted using the technician terminal to increase or decrease the range of ratios selectable by color sensitivity value, but this is not normally done by an ordinary operator.

These ratio values are significant in that they are used to characterize incoming products into three categories. Products with a red/green ratio of 3.5 or more are considered red tomatoes and are automatically accepted. Products with red/green ratio of 0.5 or less are considered green tomatoes and are automatically rejected. The products having a red/green ratio between 3.5 and 0.5 are considered "breakers". Whether or not the breakers are accepted depends on the location of the trip line.

With the factory settings of 3.5 for red tomato value and 0.5 for green tomato value, a color sensitivity value of 00 sets the trip line at a ratio of 0.5. This directs the sorting machine to accept all red product and most breaker product. If the color sensitivity is set to 99, the trip line moves to 3.5 allowing only the red product to be accepted and all others rejected. In FIG. 2, the trip line 104 is positioned at ratio 1.25 with a color sensitivity setting of 25.

Most electronically controlled optical sorters function under the same or similar principles. However, they do not possess the capability to dynamically adjust the selected color sensitivity value to optimize the efficiency of the sorting machine. This capability, or "autotrip" function, is implemented in the preferred embodiment of this invention as a software algorithm in erasable programmable read only memory (hereinafter called "EPROM") used in conjunction with the microprocessor and available RAM.

The autotrip algorithm includes two phases. First, the autotrip algorithm effectively adjusts the color sensitivity value set by the operator causing the products to be sorted in accordance with an autotrip value versus the color sensitivity value. This has the effect of moving trip line 104, FIG. 2, to autotrip line 109 such that all product below the autotrip line will be rejected. Second, the algorithm provides the means for dynamically recalculating the autotrip value in accordance with the nature of the objects being sorted.

Figure 3:
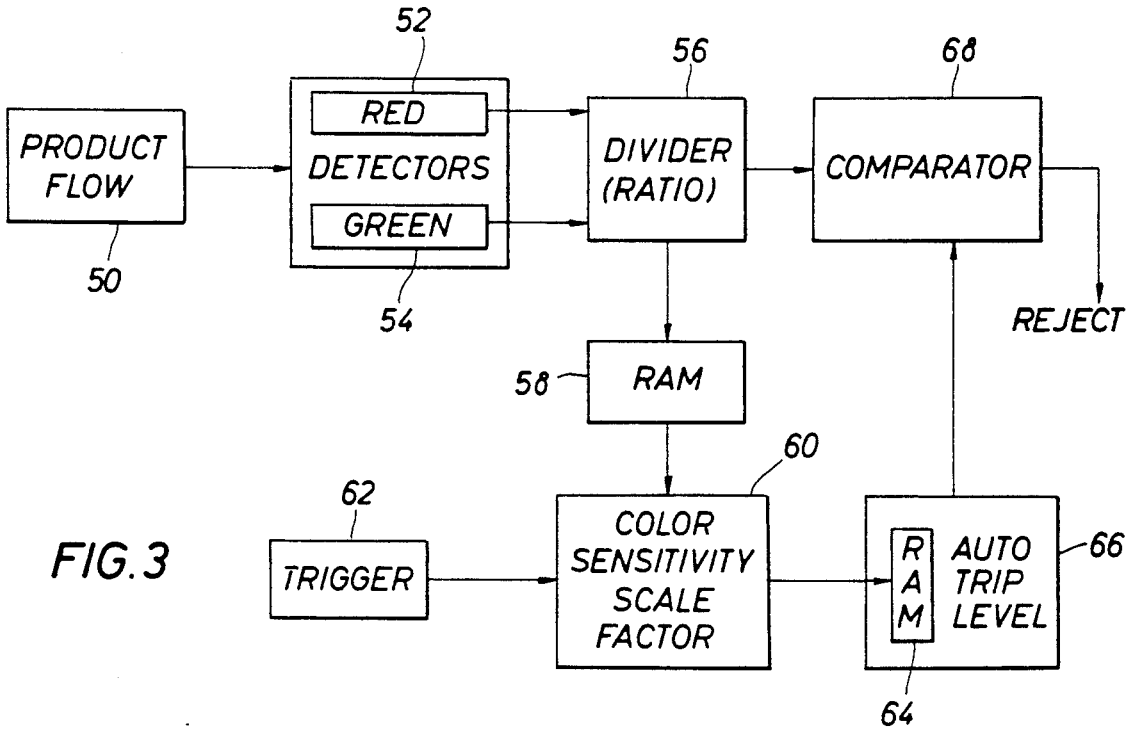
FIG. 3 is a simplified block diagram of the dynamic trip level setting apparatus in accordance with the present invention.

Referring to FIG. 3, a simplified block diagram of the apparatus employed herein is shown. The flow diagram of the sorting operation is described below. Generally, product flow 50 in accordance with the above description is sensed by "red" detector 52 and "green" detector 54 and the electrical signals carrying the reflectance color value for each product sorted in terms of its redness and its greenness is applied to divider circuit 56, which determines or calculates a ratio value of redness to greenness. In a general sense, the output from divider 56 is a ratio output of the first-to-second reflectance color values when redness is considered the first reflectance color value and green is considered the second color value.

The ratio output is applied to random access memory (RAM) unit 58, which accepts value after value until it is full and thereafter replaces the oldest value applied with the newest value applied. As noted above, each value can be based on an incremental movement of each product sorted. Alternatively, each product can be determined for redness and greenness and determine a single value for each, the ratio of which is then applied to RAM 58.

Logic device 60 develops an output which is the color sensitivity scale factor for the machine as determined by the ratio value numbers stored in RAM 58. Such device can merely develop an average scale factor or number from the values stored or it can develop a weighted average, if desired. Preferably, however, it develops a number employing a desirable algorithm, as hereinafter described, to achieve a desirable inspection result from an entire inspection array of sorted products. In any event, a scale factor output from logic device 60 is produced each time there is an output from trigger 62, which may be each time there is an output from a timer or, alternatively, each time a product is sorted.

In either event, the output from logic device 60 is applied to battery-backed RAM 64 located in autotrip level means 66. RAM 64 initially is loaded with a starting or initial value, such as normal trip line 104 explained above in connection with FIG. 2. Each time that a scale factor output is produced from logic device 60, RAM 64 is updated and the output of autotrip level means 66 is modified accordingly.

The output of autotrip level means 66 is applied to comparator 68, its other input being from divider 56. When the comparison exceeds a predetermined comparison number, which can be "1" for convenience, then a reject signal is produced, which results in a product being ejected, as discussed above. If such comparison number is not exceeded, then no reject signal is produced.

Figure 5:
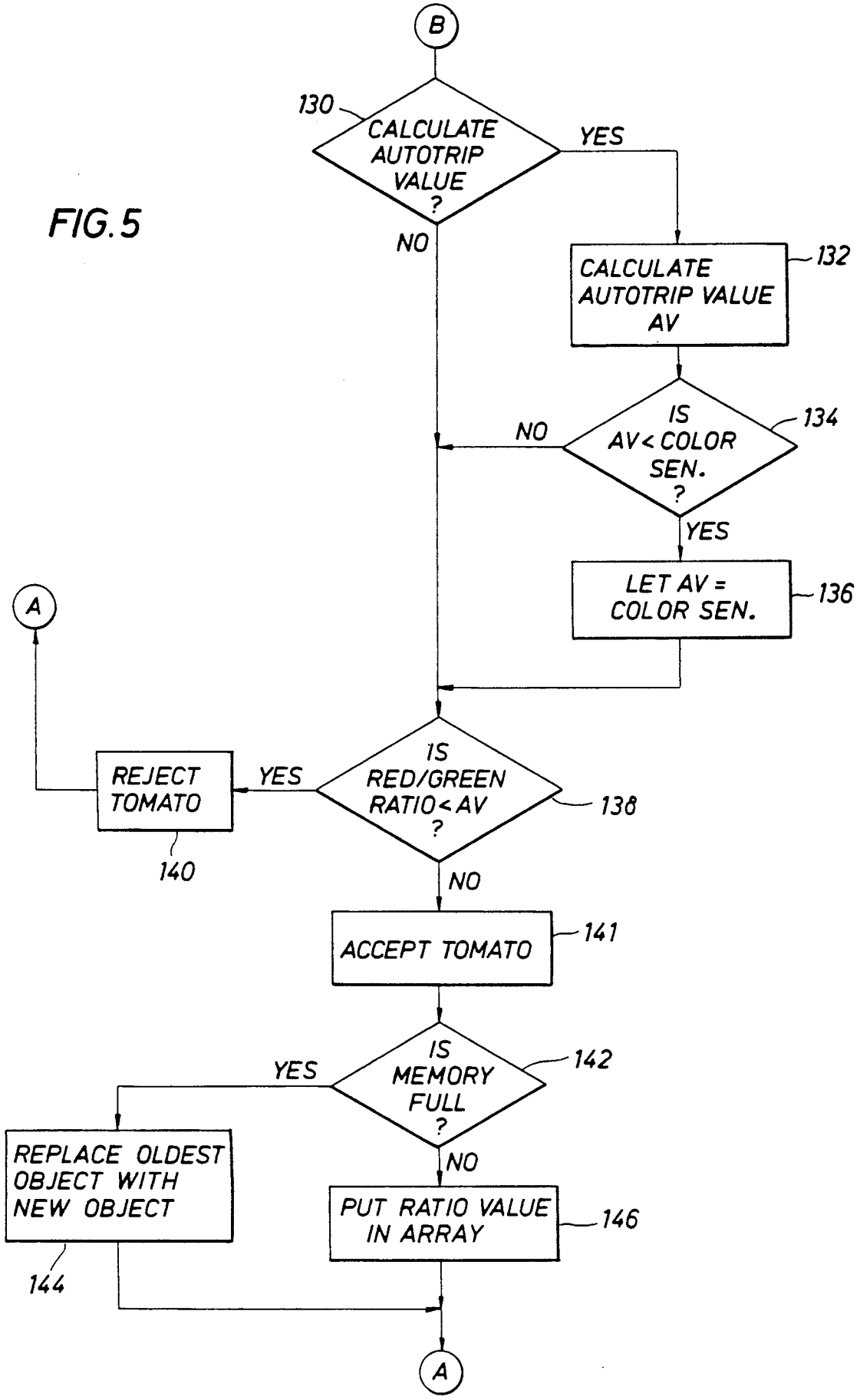

Referring now to FIGS. 4 and 5, a flow diagram of the autotrip algorithm is shown. First, the sorting machine is initialized for the product to be sorted, Step 110. This system automatically sets the red tomato value (R) to 3.5, the green tomato value (G) to 0.5 and the autotrip sensitivity factor (SF) (discussed in detail later on) to 1. The values may vary depending on the machine used and the product being sorted.

Next, the operator selects a color sensitivity value, color sensitivity, Step 112, and begins the sorting process, Step 114.

Each product is scanned to determine its red/green ratio, Step 116. This ratio is compared to the color sensitivity value, Step 118. If the ratio is less than the color sensitivity, the tomato will be rejected, Step 120.

If the ratio is not less than color sensitivity, then it is compared to autotrip value (AV), Step 138. If the red/-green ratio is less than autotrip value (AV), the tomato is rejected, Step 140. If the ratio is not less than autotrip value (AV), then the object is accepted, Step 141. Then the ratio is posted in RAM memory array for autotrip value calculation.

A random access memory array is tested to see if it is full. If the memory array is not full, the ratio is placed sequentially in the array. Subsequent ratios will also be placed in the array sequentially until it is full. In the event the array is full, then the oldest object in the array is replaced with the new object. Here the product is characterized as a magnitude of color. However, depending on the machine, an object can also be identified by size or in any other manner.

Phase two of the autotrip algorithm includes the calculating of an autotrip value. This routine can be entered into in a number of ways.

First, this routine can be entered into at timed intervals, for example, every few thousandths of a second. There may or may not be objects previously posted by phase one of the algorithm waiting. Therefore, on entry, flags are tested to determine if any objects are waiting to be put in autotrip's memory array. If there are no objects waiting, then a test is determined if autotrip is to update on timed intervals. A new value for autotrip value will be calculated if appropriate.

Autotrip may also be set to update its calculated autotrip value after one or more objects have been put in memory.

The autotrip value can also be calculated in a number of ways. The autotrip algorithm of the preferred embodiment uses the following formula to derive autotrip value:

$$AV=SF*[(R-G)*((\%B+\%G)/100)]+G$$

where:

AV=Autotrip value (ratio),
R=red tomato value (ratio),
G=green tomato value (ratio),
%B=percentage of Breakers in array,
%G=percentage of green in array, and
SF=autotrip sensitivity factor (scale factor).

The red tomato value (R) and the green tomato value (G) are defined when the machine is initialized, FIG. 4, Step 110. The percentage of breakers (%B) is the ratio of the number of products in memory having a red/-green ratio less than red tomato value (R) and greater than green tomato value (G) to the total number of products in memory. The percentage of green (%G) is the ratio of the total number of products with a red/-green ratio equivalent to green tomato value (G) to the total number of products in memory. The autotrip sensitivity factor is initialized to 1 as shown in FIG. 4, Step 110.

Figure 6:
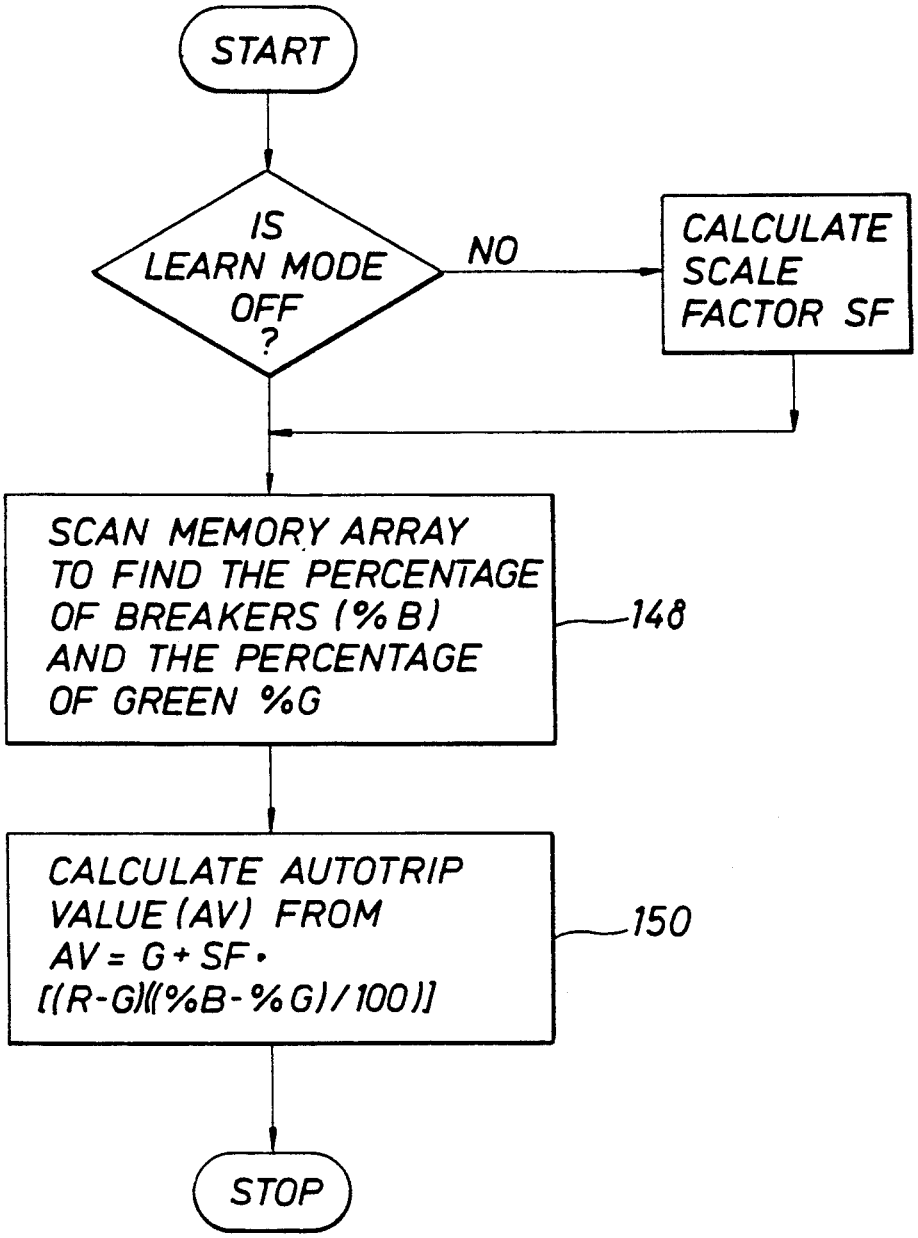
FIG. 6 is a simplified flow diagram of the autotrip function for a sorting machine in accordance with the present invention.

FIG. 6 shows a flow diagram of the autotrip value calculation. First the memory area is scanned to identify the percentage of breakers and green tomatoes in the array, Step 148. The autotrip value (AV) is calculated using the formula mentioned above, Step 150.

The resulting autotrip value is scaled the same way as the color sensitivity value. That is, a color sensitivity value range of 00–99 represents ratios from 0.5 to 3.5 if those are the ratios set for green tomato value and red tomato value.

The autotrip algorithm will use the autotrip value only if it is larger than the color sensitivity value, FIG. 5, Step 134. This restricts autotrip from accepting product that is greener than the color sensitivity value. Since this machine displays the autotrip value, an indication of autotrip's desire to move below the color sensitivity value can be seen when the number in autotrip window is the same as the value in the color sensitivity window.

The following are two extreme calculations of autotrip value:

1. Assume there are only green values in memory and no red.

$$AV=1[(3.5-0.5)*((0+100)/100)]+0.5=3.5$$

In this case the autotrip is adjusted to a ratio of 3.5 which will reject all product below 3.5 to maximize the red content of the load. This is the appropriate result because the sorting machine is now more sensitive in that it will only accept red tomatoes in areas that are green. This will reduce the overall chance of green tomatoes being accepted.

2. Assume there are only red values in memory and no green.

$$AV=1[(3.5-0.5)*((0+0)/100)]+0.5=0.5$$

Autotrip value is adjusted to a value of 0.5 to reject only the product below 0.5 accepting all red and all breakers. In areas where only red tomatoes are being sorted, the machine does not have to be as sensitive.

Once a new autotrip value is calculated, it will be used until another is calculated.

Autotrip algorithm also provides the user with the opportunity to heighten the sensitivity of the sorter by placing it in learn mode. The autotrip algorithm in learn mode will derive a scale factor (hereinafter called the autotrip sensitivity scale factor (SF)) to be used in the autotrip algorithm based on the following formula:

$$SF=\frac{C-G}{(R-G)((\%B+\%G)/100)}$$

where:

C=color sensitivity value,
R=red tomato value (ratio),

G=green tomato value (ratio),
%B=percentage of breakers,
%G=percentage of green, and
SF=autotrip sensitivity factor (scale factor).

The color sensitivity value (C) is the red/green ratio corresponding to the color sensitivity selected by the operator.

The red tomato value (R) and the green tomato value (G) are defined when the machine is initialized, FIG. 4, Step 110. The percentage of breakers (%B) is the ratio number of products in memory having a red/green ratio less than red tomato value (R) and greater than green tomato value (G) to the total number of products in memory. The percentage green (%G) is the ratio of the total number of products with a red/green ratio equivalent to green tomato value to the total number of products in memory.

As the equation demonstrates, the autotrip sensitivity factor is a function of the actual color sensitivity value (V) and the actual field conditions as indicated by the percentage of breakers and green tomatoes. The formula is designed such that autotrip value will be the same as the color sensitivity factor for the same field conditions. However, as the field conditions vary, the autotrip sensitivity factor remains constant while the autotrip value varies.

In the preferred embodiment, the autotrip feature must be turned off while the system sorts products in accordance with color sensitivity value selected by the user. After a predetermined amount of time, at least one minute, autotrip sensitivity calculator should be activated by the user. The resultant autotrip sensitivity factor value will replace the initialized value in memory and will be used in any new autotrip value calculations.

In order to fine tune the autotrip sensitivity value to the product being sorted, the operator may adjust the color sensitive value to obtain an acceptable color level after observing the overall color of the product. To confirm the successful completion of the autotrip sensitivity value, the algorithm displays it for the user.

While a preferred embodiment has been described and illustrated and some alternatives have been described, it will be understood that the invention is not limited thereto, since many modifications may be made and will become apparent to those skilled in the art.

What is claimed is:

1. In a products sorting machine having an optical discriminator employing a first detector of a first reflectance color value for each product sorted, a second detector of a second reflectance color value for each product sorted, and ratio means connected to the first detector and the second detector for determining the ratio of first-to-second reflectance color values, a predetermined high ratio number of first-to-second reflectance color values indicating an acceptably colored product, a predetermined low ratio number of first-to-second reflectance color values indicating an unacceptably colored product, and a normal trip line ratio equivalent to a first-to-second reflectance color ratio between the high ratio and the low ratio indicating a ratio value of acceptability, a dynamic trip level setting apparatus, comprising autotrip level means, including a battery backed RAM for storing a color sensitivity scale factor for establishing an autotrip level ratio value output between the high ratio value and the low ratio value, means, connected to the ratio means for determining the first-to-second reflectance color ratio value for each successive product sorted, for storing each of said ratio values in a random access memory (RAM) until said RAM is full and thereafter replacing the oldest ratio value therein with the newest ratio value, and scale factor means, connected to said RAM, for periodically employing the ratio values in said RAM for determining a new color sensitivity scale factor for said battery-backed RAM in said autotrip level means to produce a change in the autotrip level ratio value output wherein product acceptability is based on the normal trip line ratio when the autotrip level ratio is less than or equal to the normal trip line ratio, and is based on said autotrip level ratio when it is greater than the normal trip line ratio.

2. A dynamic trip level setting apparatus in accordance with claim 1, and including trigger means connected to said scale factor means for periodically producing an output from said scale factor means to said battery-backed RAM.

3. A dynamic trip level setting apparatus in accordance with claim 1, wherein said trigger means is activated with each product sorted.

4. A dynamic trip level setting apparatus in accordance with claim 2, where in said trigger means includes a timer.

5. A dynamic trip level setting apparatus in accordance with claim 1, wherein said products sorted are tomatoes, said first reflectance color value is defined as red, and said second reflectance color value is defined as green.

6. A dynamic trip level setting apparatus in accordance with claim 5, wherein said autotrip level means determines its output employing the following algorithm:

$$AV=SF*[(R-G)*((\%B+\%G)/100)]+G$$

where:

AV=autotrip ratio value,
R=red tomato initial value,
G=green tomato initial value,
%B=percentage of Breakers in array defined as the number in the battery-backed RAM having a red/green ratio less than value R and greater than value G,
%G=percentage of green in the array, and
SF=color sensitivity scale factor.

7. In a products sorting machine having an optical discriminator employing a first detector of a first reflectance color value for each product sorted, a second detector of a second reflectance color value for each product sorted, and ratio means connected to the first detector and the second detector for determining the ratio of first-to-second reflectance color values, a dynamic trip level setting apparatus, comprising means, connected to the ratio means for determining the first-to-second reflectance color ratio value for each successive product sorted, for storing each of said ratio values in a random access memory (RAM) until said RAM is full and thereafter replacing the oldest ratio value therein with the newest ratio value, and autotrip level means, connected to said RAM, for establishing an autotrip level ratio value output from said first-to-second reflectance color ratio values stored in said RAM, wherein product acceptability is based on said autotrip level ratio, thereby determining product acceptability as a function of incoming product profile.

* * * * *